United States Patent [19]

Natwick

[11] 4,215,867

[45] Aug. 5, 1980

[54] TARGETS AND GATED FIRING GUNS FOR PROPELLING BALLS THERETO

[75] Inventor: Vernon R. Natwick, Saratoga, Calif.

[73] Assignee: Ramtek Corporation, Santa Clara, Calif.

[21] Appl. No.: 35,821

[22] Filed: May 4, 1979

Related U.S. Application Data

[62] Division of Ser. No. 814,329, Jul. 11, 1979, abandoned.

[51] Int. Cl.³ ..... F41B 11/00

[52] U.S. Cl. ..... 273/357; 124/77; 273/397; 273/371

[58] Field of Search ..... 273/101; 124/59, 77

[56] References Cited

U.S. PATENT DOCUMENTS

| | | | |
|---|---|---|---|
| 1,477,698 | 12/1923 | Emmelin | 124/51 R X |
| 2,398,813 | 4/1946 | Swisher | 273/101 |
| 3,680,863 | 8/1972 | Wallace et al. | 273/101 |
| 3,748,751 | 9/1972 | Breglia et al. | 273/101.2 |

*Primary Examiner*—Anton O. Oechsle

*Attorney, Agent, or Firm*—Limbach, Limbach & Sutton

[57] ABSTRACT

An arcade amusement gun of the type which pneumatically shoots a rubber ball toward a hollow target with each pull of the trigger is gated by a master control so that its firing rate is the same as the other arcade amusement guns in a grouping of such guns.

1 Claim, 13 Drawing Figures

TARGETS AND GATED FIRING GUNS FOR PROPELLING BALLS THERETO

This is a divisional of application Ser. No. 814,329, filed July 11, 1979, abandoned.

BACKGROUND OF THE INVENTION

The invention relates to an arcade amusement device and more particularly to a pneumatic gun game.

In the sale and manufacture of arcade amusement devices there are two primary considerations which must be taken into account. The first consideration is how attractive the game is to the player and the second consideration is how attractive the game is, from an operational point of view, to an arcade owner. In the latter category fall such questions as the relative amount of maintenance required to run the game and the amount of revenue which is likely to be generated by the game.

While target shooting games have long been in existence, it has been found that a game in which a tangible object is launched by the player has more appeal than electronic target shooting type games. Target shooting games involving the actual firing of a live round in a gun, however, have many drawbacks such as noise and operator safety. One attempt to overcome this problem has been a pneumatic gun which launches tennis balls at stationary or moving targets. This gun is known under the trademark of BAZOOKA and is manufactured by Jo Paul Industries, Lake Oswego, Oreg.

In the BAZOOKA gun, tennis balls are gathered up by the arcade operator and loaded into a metal rack which is then positioned on top of the gun. The rack is tilted at such an angle that the balls roll toward one end of the rack. The player, by sliding back a bolt, allows one ball at a time to fall into a breach within the gun. In this way, the gun is loaded in a single shot fashion by the player. The player fires the gun by pulling a trigger or pushing a button. The fired tennis ball travels in almost a straight projectory to strike an upright target. The balls are returned to the player area by means of a trough running along a side wall. The balls accumulate in a holding pen which serives all of the guns for that arcade device. The operator must gather up the balls, one rack at a time, and supply each gun with a filled rack of balls.

The BAZOOKA gun has many drawbacks from the operator and player point of view. The sound made by the gun is so deafening that sound-proofing for the operator is required. The manual loading of the gun requires that the player reaim the gun each time he wishes to fire the gun. This introduces an element of skill into the gun which allows the arcade operator to award prizes to the players who achieve a certain skill in hitting the targets. Without this element of skill, the arcade operator could not award prizes without violating the various state gambling laws. Unfortunately, the requirement that the player manually load the gun by moving the bolt detracts from the appeal of the gun, making it seem rather old-fashioned. The guns are mounted in a gimbal arrangement which allows no recoil of the gun upon firing. This also reduces the realism of the gun for the player. Because each gun fires at a different rate, it is not possible to have completely fair competitive shooting between several guns and players.

All in all, the BAZOOKA type gun suffers from the disadvantages that it is unrealistic to the players, produces a deafening sound, and requires a considerable amount of labor in reloading the guns and showing the players how to operate the guns.

SUMMARY OF THE INVENTION

The above and other disadvantages of prior art arcade gun amusement devices are overcome by the present invention of an amusement game comprising a target, a plurality of balls, a player fired gun for shooting the balls toward the target and means for automatically returning the balls from the target to the gun, including means for automatically loading one ball at a time into the gun for firing, and means for artificially producing a recoil of the gun upon the firing of each ball.

In the preferred embodiment of the invention, the gun is gimballed such that the gun has limited movement about vertical and horizontal axes so as to allow the gun to be accurately aimed by the player. The balls are loaded from beneath the gun along the horizontal and vertical axes of movement of the gun. The gun is of the breech loading type and as each ball is received by the ball loading means at the breech, the ball is automatically spun and thereby caused to roll into the gun breech. In the preferred embodiment of the invention, the balls are pneumatically ejected from the gun after the closing of the breech door and the depression of a trigger switch.

The target includes a plurality of ball receiving, inclined receptacles which are connected to a passageway underneath the game. The passageway is inclined to allow the balls to roll back to the player area where they are automatically lifted up to the gun and are stored for loading one at a time into the gun. The gun is fired automatically by the player simply by pressing a button. The artificial recoil is generated by an actuator which applies a momentary force to pivot the gun about its horizontal axis of movement a finite time after the gun is fired by the player. In this way, the player may not simply draw a bead on a target and fire a plurality of balls without changing his aim. The recoil forces the player to reaim each time he fires, thus introducing an element of skill which takes the game outside of the various state gambling laws. This is an attractive feature for the arcade operator since he can then award prizes to the skilled players and generate enthusiasm among the players for playing the game repeatedly.

In the preferred embodiment of the invention, the balls are made of butyl rubber and have minimal rebound. The balls are also coated with polytetrafluoroethylene (known in the trade under the DuPont trademark TEFLON) to reduce friction during their return to the gun. The balls are not fired in a straight trajectory, but on the contrary are lobbed by the gun toward the target. In this way, a relatively small pneumatic charge is required to launch the balls and the gun does not have a deafening sound.

In one preferred embodiment, the firing rate of a plurality of the guns may be synchronized by the arcade operator to allow competitive play under uniform conditions. It is therefore an object of the present invention to provide in combination with a plurality of targets, balls and ball return means an arcade amusement gun device in which the single shot firing rate of a plurality of guns may be synchronized by the arcade operator to allow competitive play under uniform conditions.

The foregoing and other objectives, features and advantages of the invention will be more readily understood upon consideration of the following detailed description of certain preferred embodiments of the invention, taken in conjunction with the accompanying drawings.

DETAILED DESCRIPTION OF A PREFERRED EMBODIMENT

Figure 1:
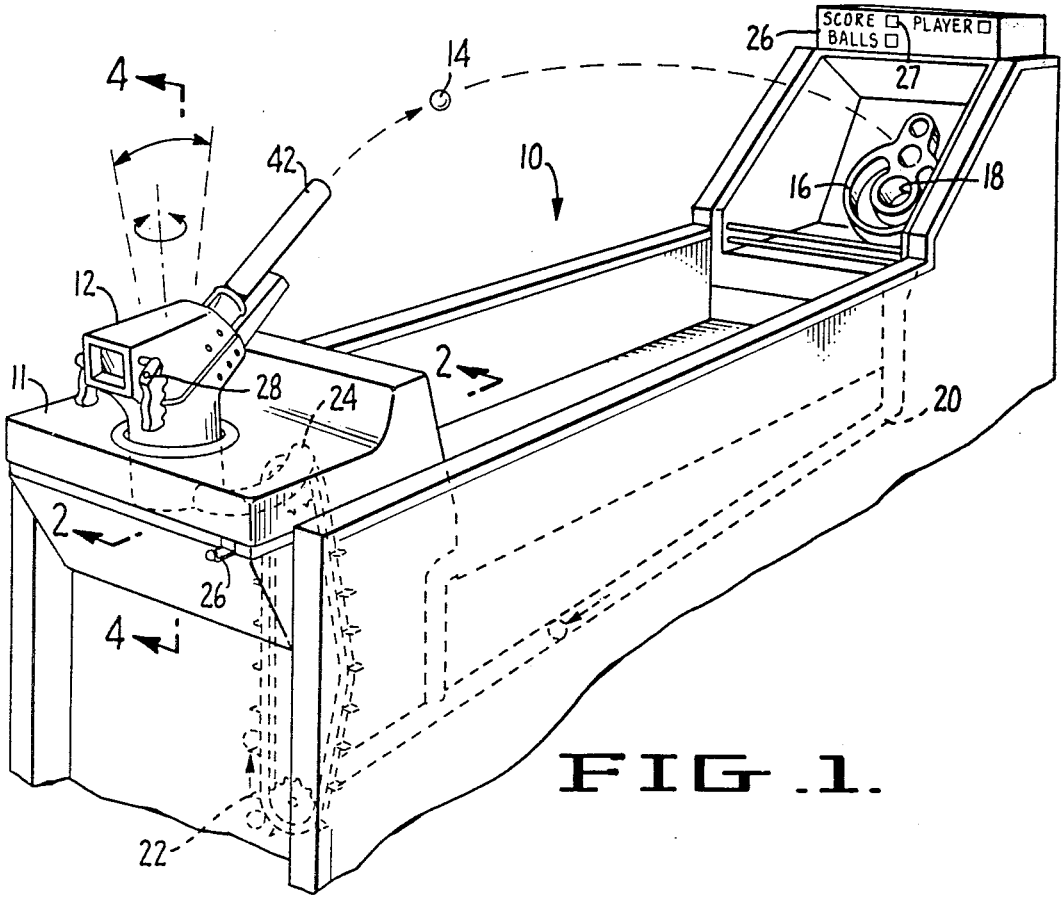
FIG. 1 is a perspective view of an arcade amusement gun device according to the invention.

Referring now more particularly to FIG. 1, the amusement gun device 10, according to the invention, is illustrated. The gun 12 is pivotally mounted in a console 11 so that it may be pivoted about both a horizontal and a vertical axis to aim the gun. The operator controls the firing of the gun through a push button switch 28 on a pair of handles on the gun. Upon firing, the gun lobs a rubber ball 14 toward a target 16. The target 16 is inclined and includes a plurality of ball receiving receptacles of varying diameters 18. Each of the ball receiving receptacles is connected to a passageway 20 in the bottom of the game which allows the balls to return under the force of gravity to the player area at the console 11. A motor driven belt lift mechanism 22 raises the balls from the bottom of the game to the top of the console area where they are stored in a curved, horizontal rack 24 for automatic reloading into the gun 12, as will be explained in greater detail hereinafter.

Figure 2:
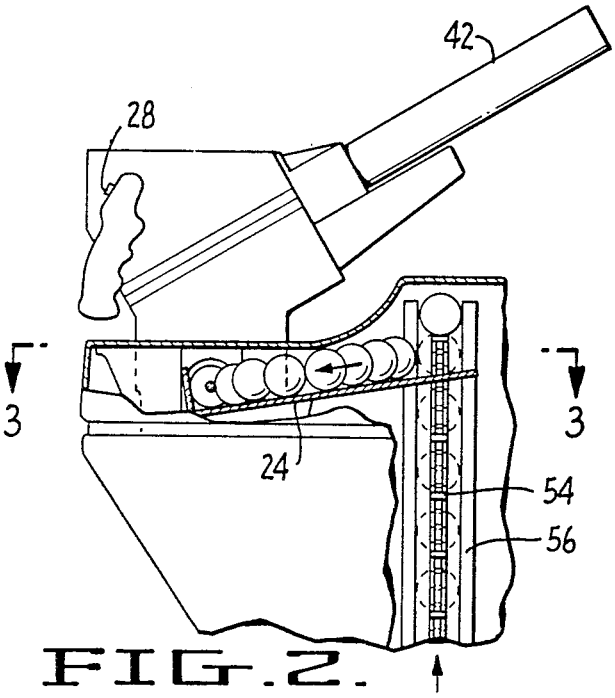
FIG. 2 is an enlarged, vertical, sectional view taken generally along the lines 2—2 in FIG. 1, with portions broken away.
Figure 3:
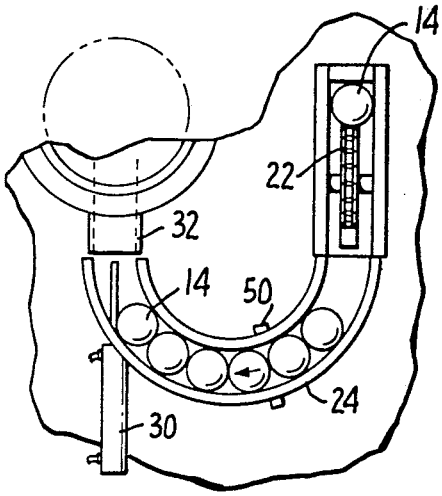
FIG. 3 is an enlarged, horizontal, sectional view taken generally along the lines 3—3 in FIG. 2, with portions broken away.
Figure 8:
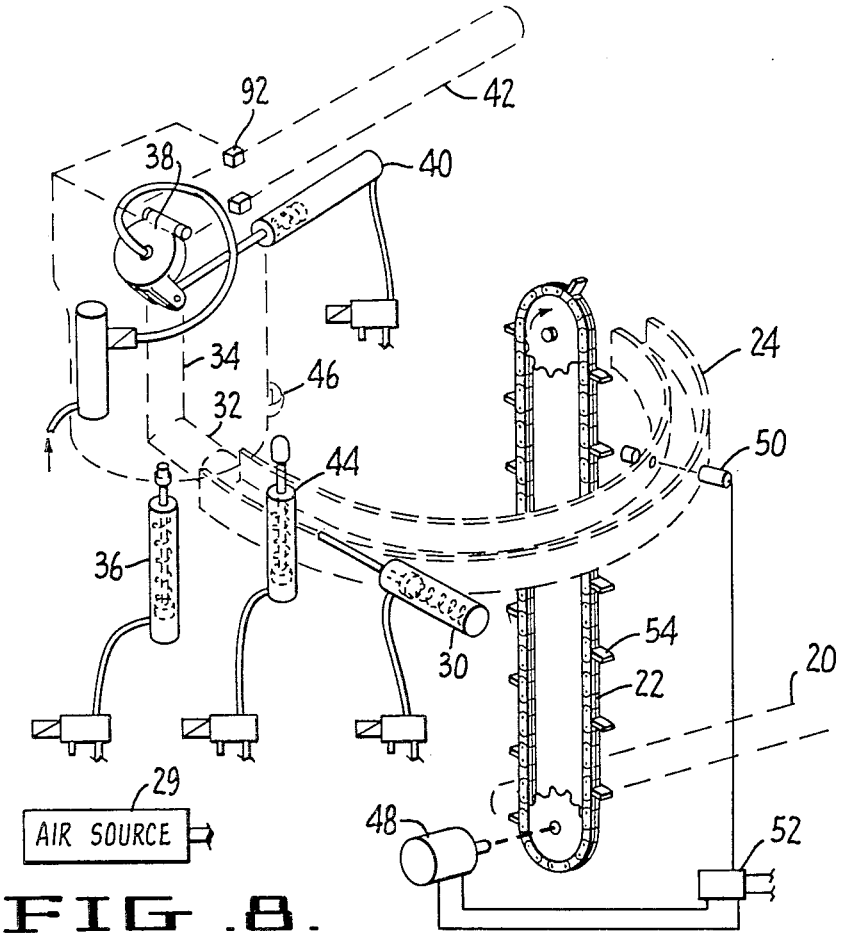
FIG. 8 is a diagrammatic view illustrating the operation of the gun depicted in FIG. 1.

Referring now more particularly to FIGS. 2, 3 and 8, the mechanism by which the returned balls are loaded into the gun will be explained. The balls 14, as mentioned above, return down the return tube 20 to the base of a lift belt 22. The belt 22 is rotated by an electric motor 48 which is under the control of a photo optic sensor 50 mounted across the upper, horizontal ball return passage 24. As long as the photo optic sensor 50 does not sense the presence of any balls, the motor 48 causes the belt 22 to lift the balls upwardly and deposit them at the mouth of the curved chute 24. As soon as the balls have backed up to the point where they block the photo optic sensor 50, the motor 48 is shut down. It will be appreciated that the motor 48 is connected to an external source if power (not shown) through a switch 52 which is controlled by the photo optic sensor 50.

The belt 22 has a plurality of projecting fingers 54 which support the balls during the lifting operation. The balls are retained over the fingers 54 by means of a vertical sleeve 56 which surrounds one side of the belt 22.

Figure 5:
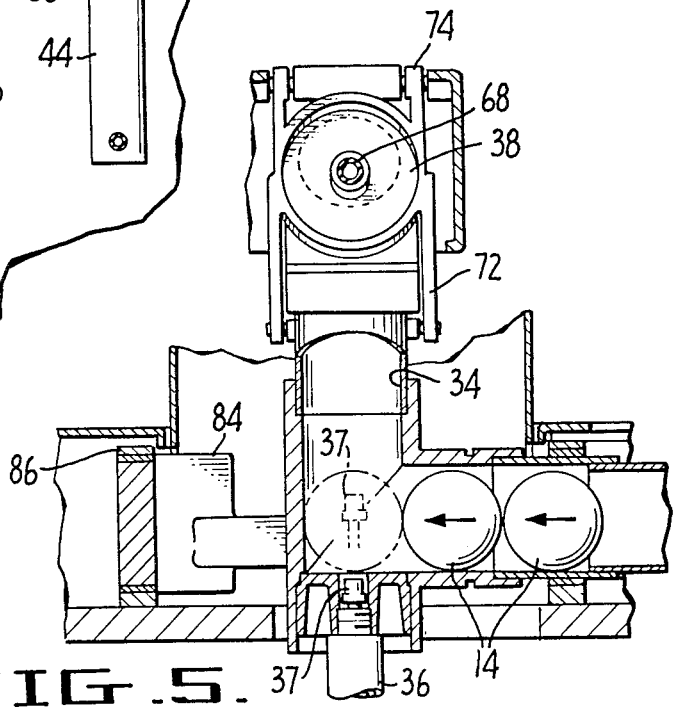
FIG. 5 is an enlarged, vertical, sectional view, with portions broken away, taken generally along the lines 5—5 in FIG. 4.

The sloping chute 24 leads the balls to the opening of a horizontal ball passage 32, as best shown in FIG. 3. The balls are caused to enter the passage 32 by means of a pneumatic actuator 30 which ejects a plunger upon the application of a control signal. The plunger of the actuator 30 pushes one ball at a time into the entrance of the passage 32. As best shown in FIG. 5, the passage 32 terminates in a vertical passage 34 to form a right angle elbow. At the bottom of the elbow is disposed a pneumatic actuator 36 which raises a plunger 37 to lift one ball 14 at a time up into the breech 58 of the gun.

Figure 4:
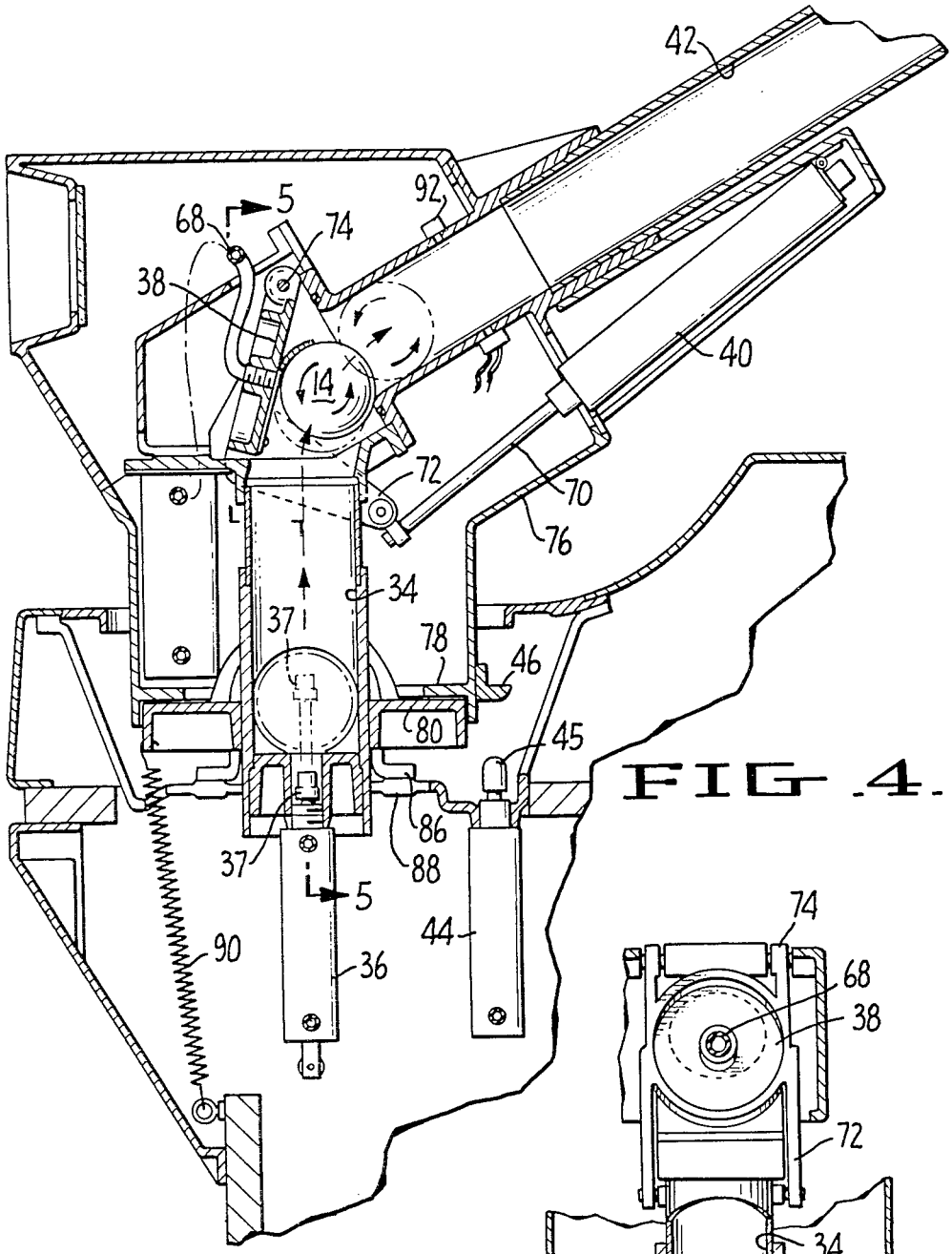
FIG. 4 is an enlarged, vertical, sectional view, with portions broken away, taken generally along the lines 4—4 in FIG. 1.
Figures 6, 7:
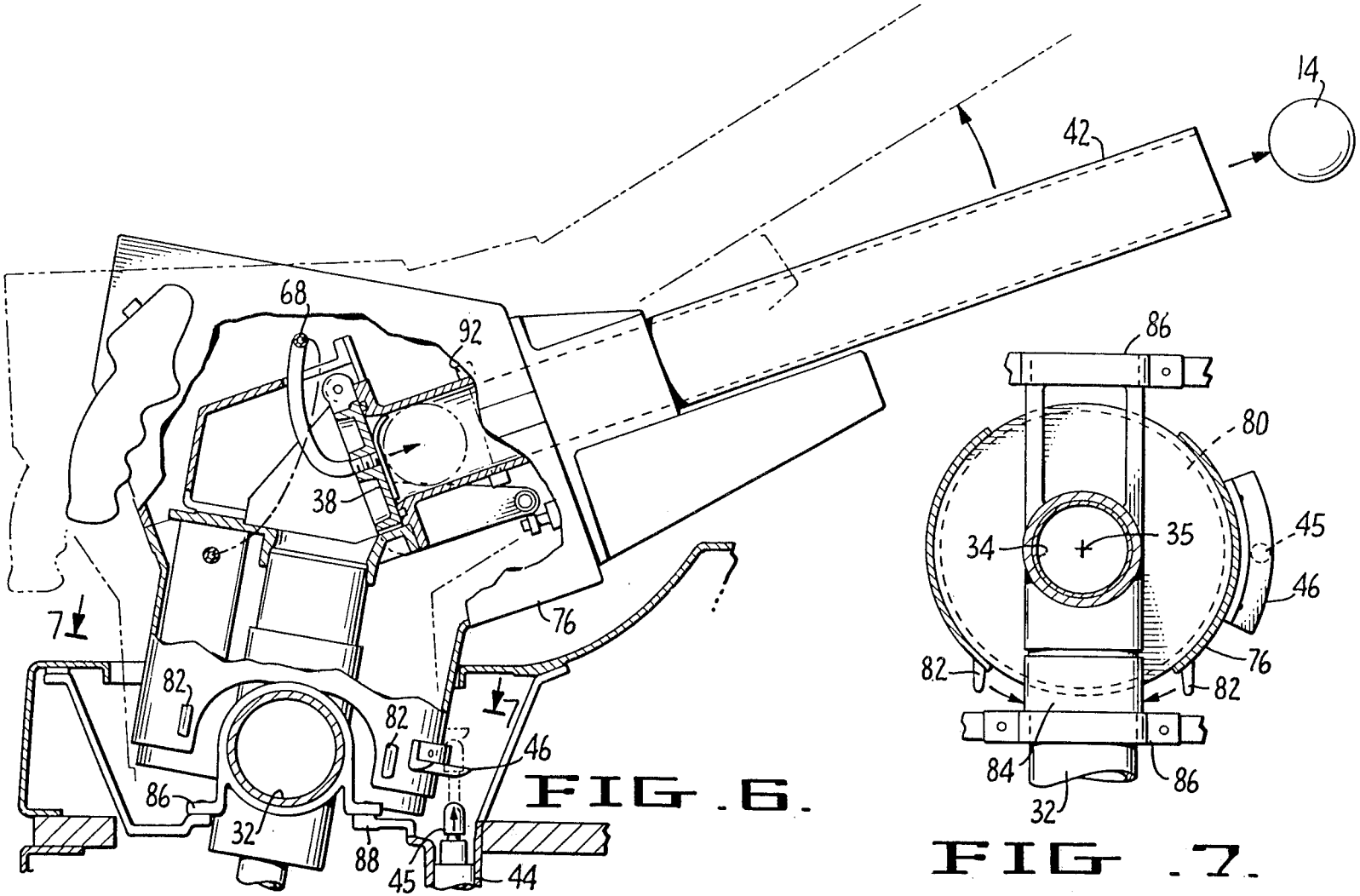
FIG. 6 is an enlarged, vertical, sectional view, with portions in elevation, which is similar to FIG. 4 but illustrating the recoil action of the gun.
FIG. 7 is an enlarged, horizontal, sectional view taken generally along the lines 7—7 in FIG. 6 and with portions broken away.
Figure 10:
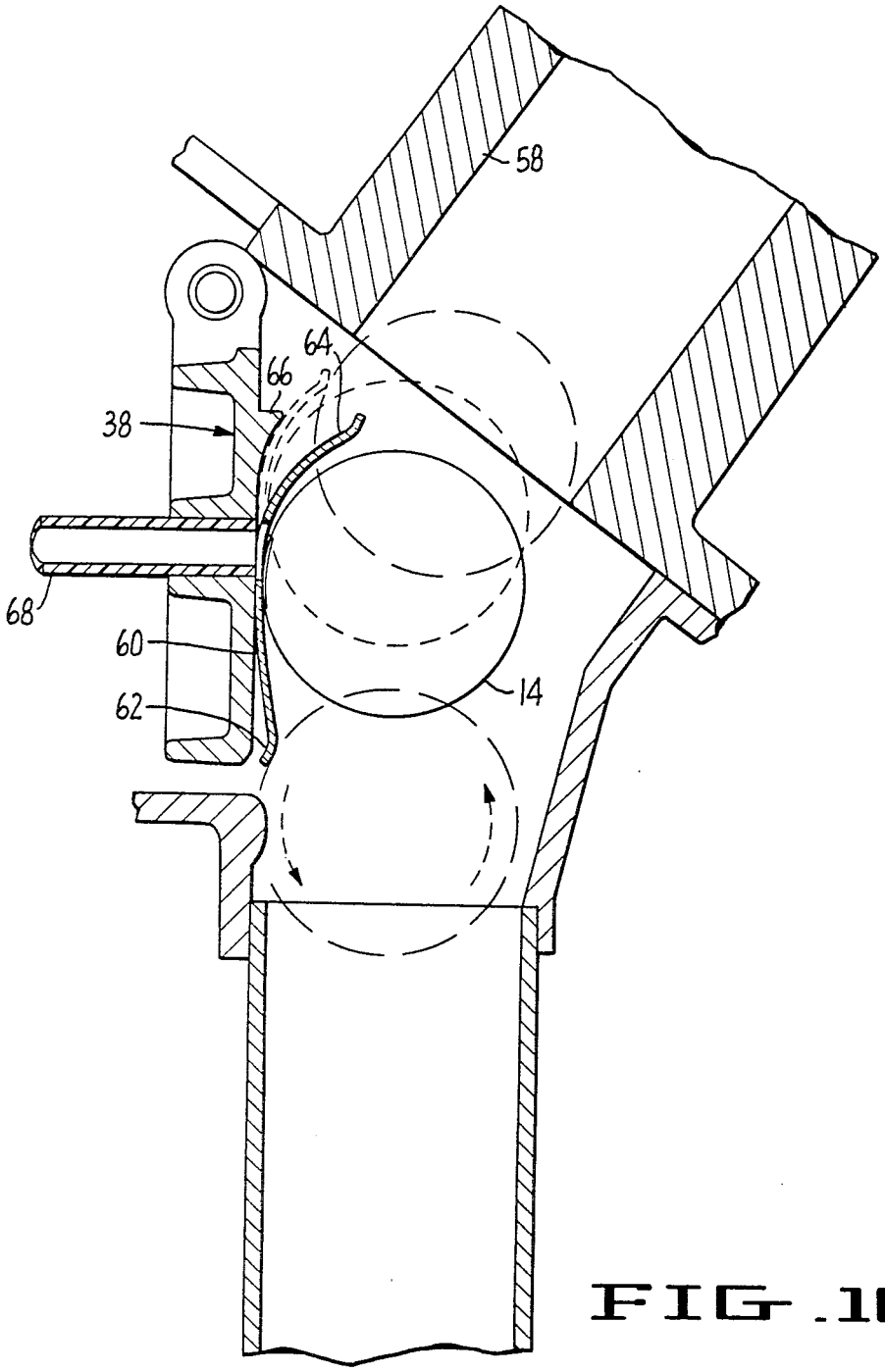
FIG. 10 is an enlarged, vertical, sectional view of the breech loading mechanism of the gun.

Referring now more particularly to FIGS. 4, 6 and 10, the operation of loading the ball 14 into the breech 58 will be described in greater detail. Because the plunger 37 only travels a portion of the way up the vertical passage 34, it does not literally push the ball into the breech 58 but simply propels the ball upward with sufficient velocity so that the ball's inertia will carry it upward until it strikes the interior surface of the open breech door 38. More particularly, as best shown in FIG. 10, the ball 14 first strikes an inwardly bent, bottom portion 62 of a curved spring deflector 60 fastened to the interior surface of the breech door 38. The impact of the ball 14 on the bottom portion 62 causes the ball 14 to begin rotating in a counter-clockwise direction, as viewed in FIG. 10. As the ball continues its travel upwardly, it collides with an arcuately curved, top portion 64 of the deflector 60, causing it to elastically deflect towards the surface of the breech door 38. This arcuately curved portion 64 continues its deformation until it meets with a correspondingly curved stop 66 on the breech door 38 near the top of the breech door. At this point, the deflector 60 no longer deflects and the ball is caused to rebound into the breech 58 where it strikes the top surface of the breech. As soon as the spinning ball hits the top surface of the breech 58, it rolls itself into the breech and then rebounds downwardly to the bottom surface of the breech where its forward momentum is stopped because the collision of the rotating ball with the bottom surface of the breech 58 tends to pull the ball backwards against the forward momentum of the ball. The net result is that the ball simply stops all motion at this point in the breech. The ball is prevented from rolling out of the breech by the deflector 60 which has now resiliently snapped back to its original position. As will be explained in greater detail hereinafter, the control system for the breech door actuator 40 is timed such that the breech door 38 is immediately caused to be closed, thereby holding the ball 14 within the breech. Compressed air is then supplied to the sealed breech through a pneumatic hose 68 fitted into the breech door 38 and connected to a source of compressed air.

The door actuator 40 has an extendible plunger 70. The end of the plunger 70 is pivotally connected to a bracket 72 attached to the door 38. The breech door 38 is pivoted about a hinge 74 to the casting which constitutes the breech 58.

As previously mentioned, the gun has a limited degree of movement about both a vertical and a horizontal axis. The gun has an outer shell or casting 76 which supports or is attached to all of the gun components either directly or indirectly. This casting 76 terminates at its lower end in an inwardly extending, annular flange 78 which is supported on a cylindrical, flat member or table 80. As best shown in FIG. 7, the casting 76 may be pivoted about a vertical axis which is co-axial with the axis of symmetry 35 of the vertically extending passage 34. The degree of pivotal movement about this vertical axis is controlled by two projecting pins 82 which are circumferentially spaced on the casing 76 from an outer sleeve 84 which is co-axial with the horizontal pipe or passage 32. This co-axial pipe 84 rotates in horizontal yokes 86 which are bolted to a stationary frame 88 of the entire console. In this manner, the gun is also pivotable in a vertical direction about a horizontal axis which is co-axial with the axis of rotation of the horizontal passageway or pipe 32. With these two degrees of movement, that is horizontal movement about the vertical axis which is co-axial with the vertical passage 34 and vertical movement about the horizontal axis which is co-axial with the horizontal passage 32, the player may aim the gun at the target.

In order to simulate a recoil of the gun upon firing of the ball, an actuator 44 is mounted in the frame 88 so that it can extend its plunger 45 upwardly to strike a flange 46 attached to the outer circumference of the casing 76 which is in vertical alignment with the barrel 42. As will be explained in greater detail hereinafter, the control system for the actuator 44 energizes it shortly after the ball 14 is fired, as best viewed in FIG. 6, to thereby forcibly raise the barrel of the gun 42 and tilt the gun about horizontal axis, as shown in dot-dashed line fasion in FIG. 6. The weight of the barrel 42 returns the gun to its normal position where it is counterbalanced by a tension spring 90 attached between the console casing and the bottom edge of the table member 80 at the back of the gun, directly opposite from the flange 46.

Figure 9:
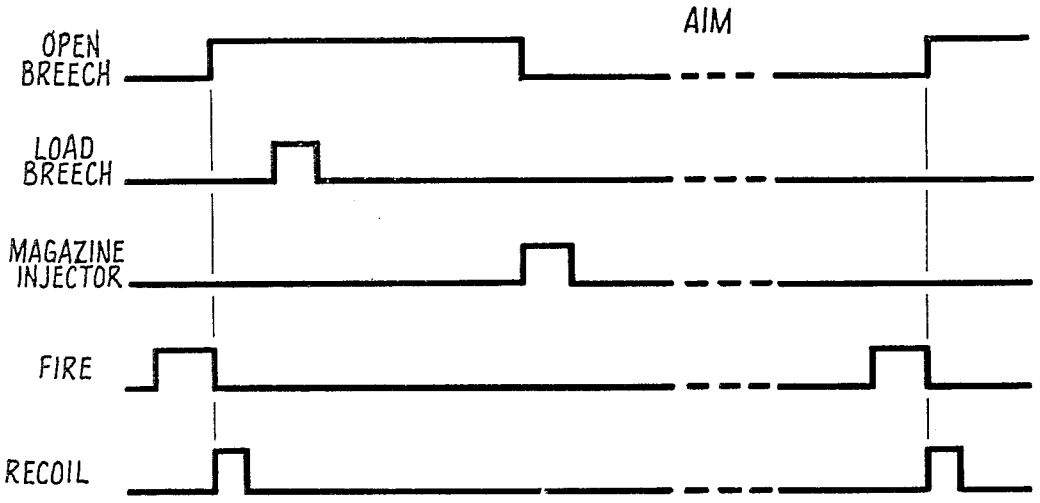
FIG. 9 is a timing diagram for use in explaining the operation of the gun as depicted in FIGS. 1 and 8.

Referring now more particularly to FIGS. 8 and 9, the sequence of operations of the control system for the amusement gun device of the invention will be described. Immediately after the gun has been fired, the actuator 44 must be energized to cause the gun to recoil. Simultaneously with the ending of the firing pulse and the beginning of the recoil pulse, the actuator 40 causes the breech door 38 to open. During the period of time in which the breech door is open, the actuator 36 raises a ball 14 which has previously been placed in the vertical passageway or tube 34 by the actuator 30 into the breech. The breech door is then closed by the operation of the actuator 40 at approximately the same time the actuator 30 introduces a new ball into the vertical passageway 34. Thereafter, the player takes aim and fires the gun which causes a pneumatic charge to be delivered through the hose 68 from a local source of compressed air 29 (FIG. 8) and the sequence is repeated.

To prevent more than one ball from being introduced into the breech at the same time, a jammed gun sensor 92, by way of a photo optic sensor, is positioned exteriorly of the breech 58 but shining through the breach, immediately ahead of the position where the ball 14 rests before firing. If more than one ball appears in the breech 58, the jammed gun sensor 92 sends a signal to the control system which prevents all of the actuators from operating with the exception of the actuator which allows a charge to be delivered to the breech 58. Thus, the breech door is not opened nor is a new ball raised into the breech until the gun is cleared.

Figure 11A:
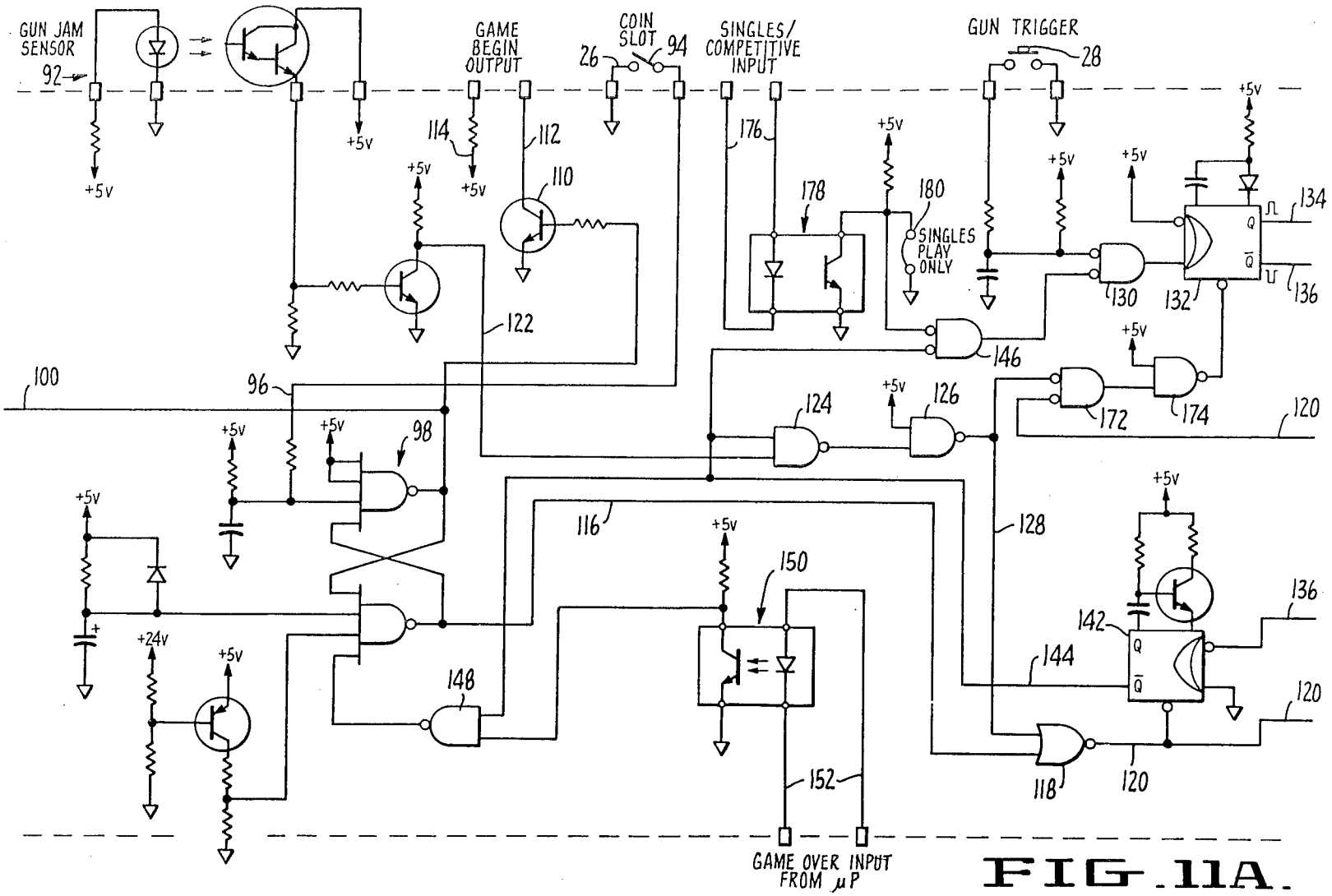
FIGS. 11A, 11B and 11C together are a schematic diagram of the control circuit for the arcade amusement gun device depicted in FIG. 1.
Figure 11B:
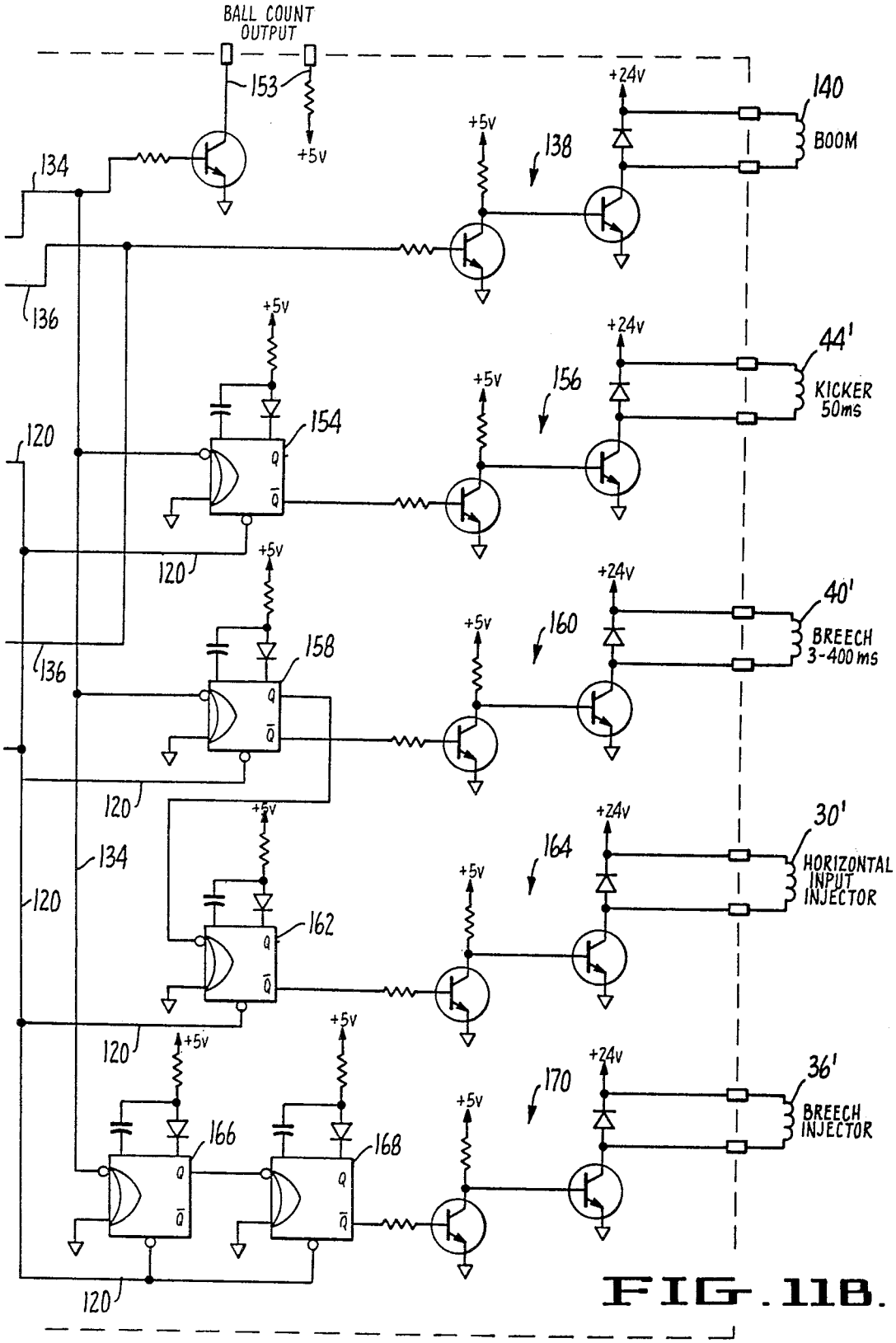
Figure 11C:
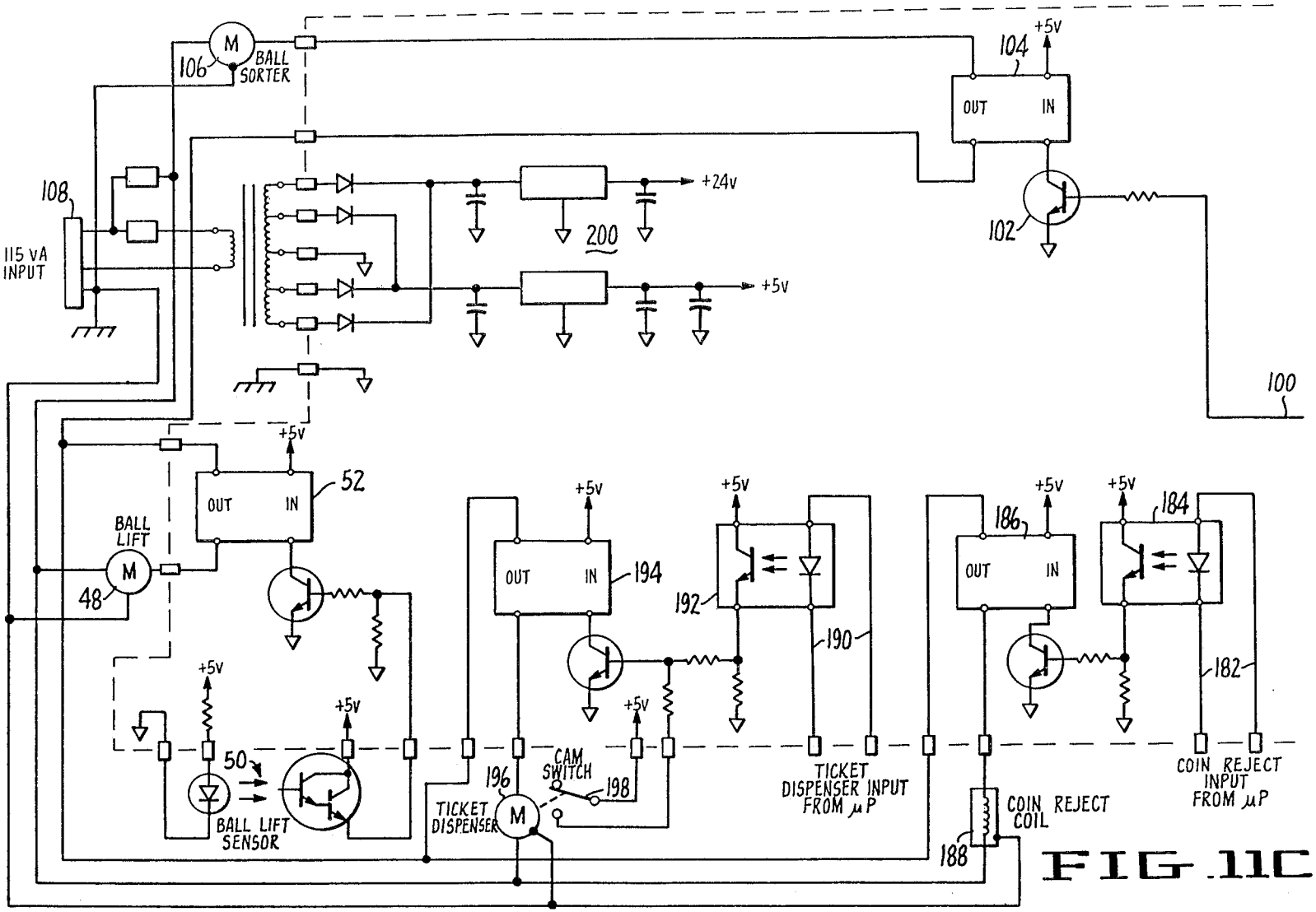

Referring now more particularly to FIGS. 11A, 11B and 11C, the control circuit for the arcade gun amusement device of the invention will be described. A scoring console 26 (shown in FIG. 1) is mounted atop the target end of the arcade gun amusement device of the invention. The scoring console includes a score indicator 27 such as an LED display or a lamp field, or an electro-mechanical indicator or the like. The scoring is done by means of a microprocessor (not shown). Since the scoring mechanism is not truly part of the invention, its details will not be described. Suffice it to say that the microprocessor in the scoring console 26 provides an end of game signal in response to a ball count output signal from the control circuit. It also supplies a signal to the player's end of the game to dispense a prescribed number of tickets in relation to the score obtained by the player. These tickets may later be redeemed for prizes or for additional turns at playing the game, as chosen by the operator.

Referring now more particularly to FIG. 11A, the game is initially actuated when the player desposits a coin in the coin slot 26, thereby closing a switch 94 which supplies a ground connection (logic low) over a lead 96 to one input of a flip-flop circuit 98. The setting of this flip-flop actually starts the game. The "game on" output signal from the flip-flop 98 is supplied via a lead 100 through a transistor switch 102 to an AC relay 104. The closing of the relay 104 energizes a ball sorter motor 106 to feed the balls 14 into the ball lift mechanism 22. The switch 104 and the ball sorter motor 106 are effectively connected in series with a 115 volt input supply 108.

The output signal on the lead 100 is also supplied through a transistor 110 to the microprocessor (not shown) via leads 112 and 114. The "game on" signal consists of a logic high which, in this circuit, is the equivalent of a positive going voltage. A corresponding logic low output signal from the flip-flop 98 is obtained over a lead 116 when the game is initially activated. This logic low over the lead 116 is supplied to one input of an inverted OR gate 118 whose output is supplied to a re-set bus 120.

Before the game can begin, it is necessary to determine that the gun is not jammed. To this end, the jammed gun sensor 92, which is a photo optic sensor, supplies an output signal via a lead 122 to one input of an inverted AND gate 124. The inverted output of the AND gate 124 is supplied to one input of an AND gate 126. The inverted output of the AND gate 126 is supplied via a lead 128 to one input of the inverted OR gate 118. From the schemmatic diagram it can be seen that the output on the lead 128 in the absence of a gun jam will be a logic low and thus the output of the inverted OR gate 118 will be a logic high.

Since the gun is loaded and ready to fire before the coin slot switch 94 is actuated, the actuation of the switch 94 enables the game to be played in the absence of a gun jam signal. The gun is fired when the player depresses the gun trigger switch 28 which sends a logic low to one input of a NAND gate 130. The output of the NAND gate 130 is fed to the negative going input of a multivibrator 132. It can be seen that the depression of the trigger switch 128 causes a logic high to be delivered from the output of the NAND gate 130 to the input of the multivibrator 132.

This causes the multivibrator 132 to be triggered such that a rising squarewave output signal appears at one output lead 134 of the multivibrator 132 and a negative going squarewave to appear at another output lead 136 of the multivibrator 132. The lead 134 constitutes a bus which supplies controlling signals to the actuators 44, 40, 30 and 36 and a ball count signal to the microprocessor via leads 153. By counting the number of fired balls the microprocessor can determine when to generate a "game over" signal to shut off the game. The negative going signal on lead 136 is supplied through a transistor switch amplifier 138 to a relay or valve actuator 140 which releases a volume of compressed air into the gun breech to fire the gun. Simultaneously, the positive going signal on lead 134 is supplied to the negative going inputs of a series of multivibrators associated with the other actuators, as will be explained in greater detail hereinafter. The negative going signal on the lead 136 is supplied to an inverted input to still another multivibrator 142. The multivibrator 142 supplies a delay signal which is sufficiently long to ensure that the gun has been reloaded before it is again fired. An output signal in the form of a negative going pulse is supplied via lead 144 to the other input of the inverted AND gate 124 and to one input of a NAND gate 146. The lead 144 is also connected to one input of an inverted AND gate 148 whose output is fed to the other input to the multivibrator 98. The other input of the inverted AND gate 148 is supplied through a photo optic coupler 150 from the microprocessor (not shown) over leads 152. The microprocessor sends the "game over" signal through the leads 152 and the photo optic coupler 150 to the input of the inverted AND gate 148. The reason for the photo optic coupler 150 is to eliminate the possibility of ground loops and thus isolate the microprocessor from the game control circuitry. The output from the photo optic coupler 150 to the input of the inverted AND gate 148 is normally a logic low while the game is on and is a logic high when the game is over. Thus, the signal supplied via the lead 144 simultaneously with the "game over" signal will cause the flip-flop 98 to be re-set and the game to be stopped, as will be explained in greater detail hereinafer.

Referring now more particularly to FIG. 11B, it will be seen that the positive going output pulse from the multivibrator 132 upon the firing of the gun is supplied via the bus 134 to the input of a multivibrator 154 whose output is supplied through a transistor amplifier 156 to energize the recoil actuator 44 through a valve or relay 44'. As will be noted from the waveform diagram of FIG. 9, this recoil takes place immediately after the cessation of the positive going pulse from the output of the multivibrator 132, that is immediately after the firing has ceased. This is accomplished because the multivibrator 154 is triggered on the negative going edge of the output pulse from the multivibrator 132.

Similarly, the output on lead 134 is fed to the input of a multivibrator 158 whose output is supplied through a transistor amplifier 160 to a relay or valve actuator 40' to energize the actuator 40 which opens the breech door. A second output from the multivibrator 158 is supplied to trigger a multivibrator 162 whose output is coupled through a transistor amplifier 164 to a relay or valve 30' of the horizontal input injector actuator 30. This ensures that a ball will be moved through the horizontal passage 32 only after the breech door has been first opened and then closed.

The output signal via the lead 134 is also supplied to the input of the multivibrator 168 whose output is supplied to a second multivibrator 168 whose output is coupled through a transistor amplifier 170 to a relay or valve 36' for the breech injector actuator 36. The purpose of having the two multivibrators 166 and 168 is to interpose a finite delay to allow the breech door 38 to be fully opened before the breech injector actuator 36 raises a ball vertically in the passage 34 into the breech. This delay is supplied by the multivibrator 166 whereas the multivibrator 168 determines how long the valve to the actuator 36 remains open.

Referring again to FIG. 11A, when the gun jams, a logic high signal is supplied via the lead 122 to the inverted AND gate 124. Prior to depressing the trigger switch 28, the status of the lead 144 will be a logic high. The output of the inverted AND gate 124 will therefore be a logic high and the output of the AND gate 126 will also be a logic high. This will cause the output of the NOR gate 118 to be a logic low. Once a logic low appears on the re-set bus lead 120, all of the multivibrators 142, 154, 158, 162, 166 and 168 are supplied with a re-set signal (which enters the multivibrators as a logic high because it is supplied to their inverting inputs) which renders them inoperable for the duration of the signal. This logic low signal via the lead 120 is also supplied to the input of a NAND gate 172 whose other input is connected to the lead 128. The output of the NAND gate 172 is supplied as one input to an inverted AND gate 174. The other input to the inverted AND gate 174 is a logic high. The output of the inverted AND gate 174 is supplied to the inverted re-set input to the multivibrator 132. Whenever the output of the inverted AND gate 174 is a logic low, the multivibrator 132 will be rendered inoperable. This condition will exist whenever both of the inputs to the NAND gate 172 are simultaneously logic lows. Thus, a jammed gun sensor signal will not disable the multivibrator 132 but will disable all of the remaining multivibrators so that the gun will be fired each time the trigger is pulled but no new balls will be loaded into the breach nor will the breech door be opened, nor will recoil take place.

In a similar manner, when the "game over" input signal is received from the microprocessor along the leads 152, the input via the lead 116 to the NOR gate 118 is a logic high because the flip-flop 98 has been re-set. This will produce a logic low output signal from the NOR gate 118 which will also prevent any of the multivibrators from operating. Moreover, because the signal appearing on the lead 128 is also a logic low, the output of the NAND gate 172 will be a logic high and the output of the inverted AND gate 174 will be a logic low which results in the multivibrator 132 also being disabled.

Since it is difficult to tune each game to operate at an identical firing rate when it is desired to operate a plurality of the gun amusement devices in competition, it is necessary to ensure that the firing rates of all of the guns do not exceed a certain standardized rate in order to render the guns competitive. To this end, the arcade operator can supply a squarewave input from an external generator (not shown) via leads 176 to a photo optic coupler 178 whose output is supplied to one input of the NAND gate 146. The other input of the NAND gate 146 is supplied via lead 144. It will be remembered that the function of the output of the NAND gate 146 is to block further actuation upon the depression of the trigger switch 28 until reloading is completed. By supplying a squarewave input signal to the other input to the NAND gate 146 the same result can be achieved, namely that the various guns which are simultaneously supplied with the squarewave signal may not fire at a rate which exceeds the period of the squarewave signal. A singles play-only ground connection 180 which normally shorts out this input to the NAND gate 146 is opened for such competitive play.

Referring now more particularly to FIG. 11C, some of the more functional aspects of the control circuit will be briefly discussed. When the microprocessor detects that too many coins have been fed into the coin slot 26, it sends a reject coin input signal via lead 182 to a photo optic coupler 184. The output from the photo optic coupler 184 activates an AC relay 186 to energize a coin reject coil 188. The result is that the coin is returned to the player.

The microprocessor, upon the obtaining of a certain score by the player, sends a ticket dispenser signal via lead 190 to a photo optic coupler 192. The output from the photo optic coupler 192 is fed through an AC relay 194 to a ticket dispenser motor 196. The motor 196 dispenses a predetermined number of tickets to the player in proportion to the player's score. These tickets may be redeemed for prizes or for additional plays at the game, at the arcade operator's discretion. The motor 196 has an automatic shut-off switch 198.

As mentioned above, the ball lift sensor 50 controls the ball lift motor 48 through an AC relay 52.

All of the various operating voltages are supplied through a fullwave power supply circuit 200.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. An amusement game comprising a plurality of targets, balls and operator fired guns for shooting the balls toward the target, each of the guns having a trigger for controlling the firing rate of each such gun with each trigger operation causing the firing of a single ball and further having means which inhibits the operation of each such trigger in response to a control signal, means for automatically returning the balls from the targets to the guns, means for automatically loading one ball at a time into each gun for firing, and means for supplying a series of trigger inhibit control signals to said trigger operation inhibiting means of each gun to simultaneously and selectively gate the firing of all of the guns to thereby establish a maximum simultaneous firing rate for all of the guns.

* * * * *

UNITED STATES PATENT AND TRADEMARK OFFICE

CERTIFICATE OF CORRECTION

PATENT NO. : 4,215,867

DATED : August 5, 1980

INVENTOR(S) : Vernon R. Natwick

It is certified that error appears in the above-identified patent and that said Letters Patent are hereby corrected as shown below:

Column 1, line 45 correct "serives" to read --services--.

Column 8, line 4, correct "168" to read --166--.

Signed and Sealed this

*Fourteenth* Day of *July 1981*

[SEAL]

*Attest:*

GERALD J. MOSSINGHOFF

*Attesting Officer*

*Commissioner of Patents and Trademarks*